US006109869A

United States Patent [19]

Maddaus et al.

[11] Patent Number: 6,109,869

[45] Date of Patent: Aug. 29, 2000

[54] STEAM TURBINE NOZZLE TRAILING EDGE MODIFICATION FOR IMPROVED STAGE PERFORMANCE

[75] Inventors: Alan Donn Maddaus, Rexford; Lawrence Donald Willey, Burnt Hills; Peter Schofield, Schenectady, all of N.Y.

[73] Assignee: General Electric Co., Schenectady, N.Y.

[21] Appl. No.: 09/132,791

[22] Filed: Aug. 13, 1998

[51] Int. Cl.[7] ..... F01D 9/04

[52] U.S. Cl. ..... 415/191; 415/208.2; 415/210.1; 29/889.1; 29/889.22; 29/889.23

[58] Field of Search ..... 415/191, 192, 415/208.1, 208.2, 181, 914, 210.1; 416/193 R, 223 A, DIG. 2, DIG. 5, 228, 237, 238; 29/889, 889.1, 889.2, 889.22, 889.23

[56] References Cited

U.S. PATENT DOCUMENTS

| | | | |
|---|---|---|---|
| 1,062,258 | 5/1913 | Schlotter | 415/210.1 |
| 4,826,400 | 5/1989 | Gregory | 415/181 |

FOREIGN PATENT DOCUMENTS

| | | | |
|---|---|---|---|
| 1037610 | 9/1953 | France | 415/181 |
| 54-45405 | 4/1979 | Japan | 415/914 |
| 916672 | 1/1963 | United Kingdom | 415/208.1 |
| 2242930 | 10/1991 | United Kingdom | 415/181 |

*Primary Examiner*—Christopher Verdier
*Attorney, Agent, or Firm*—Nixon & Vanderhye

[57] ABSTRACT

In a reverse design for partitions of a steam turbine having decreased throat dimension therebetween with increased radial height, the trailing edges are set back from approximately mid-span to a tip of the partition to increase the throat dimension with radial height relative to the prior reverse design configuration. Secondary vortices adjacent the radial inner and outer end walls are maintained separated from on another by the design, thereby minimizing or eliminating aerodynamic losses from interactive secondary flow effects while improving flow distribution at the bucket entrance and stage exit. In a further embodiment, a free vortex design having increasing throat dimension from the hub to the tip may be modified to further increase the throat dimension from the hub to approximately the mid-span by providing setbacks along the trailing edge of the partition between the hub and mid-span. The setbacks can be provided as original equipment or retrofitted in the field by cutting and removing trailing edge portions.

7 Claims, 4 Drawing Sheets

Fig. 1
(Prior Art)
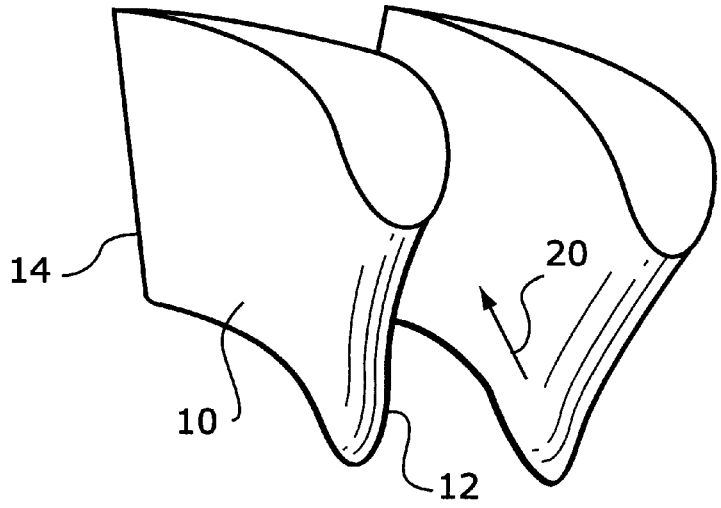
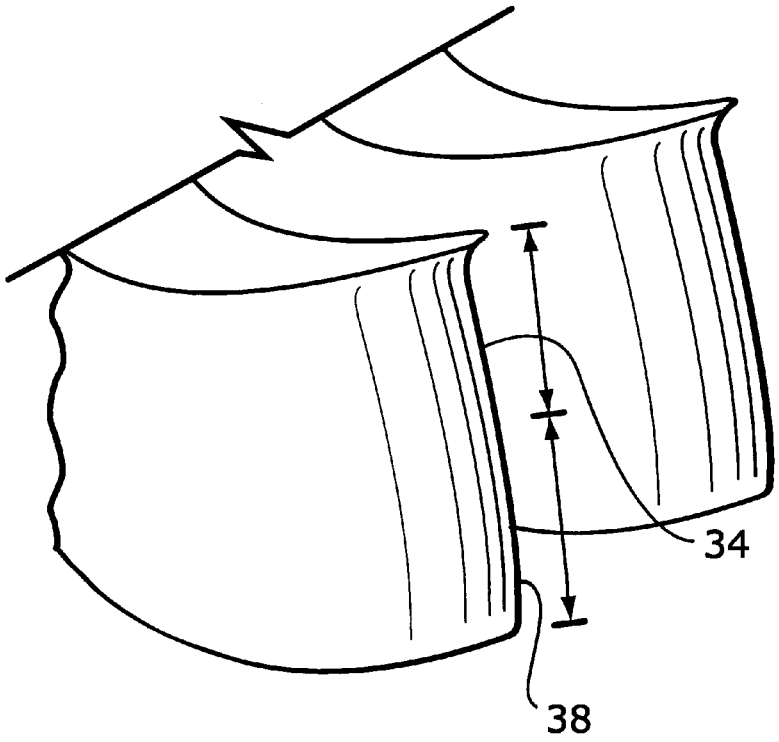
Fig. 2

STEAM TURBINE NOZZLE TRAILING EDGE MODIFICATION FOR IMPROVED STAGE PERFORMANCE

TECHNICAL FIELD

The present invention relates to steam turbines having an array of partitions defining nozzles for flowing steam to buckets and particularly relates to a modification of the trailing edges of the partitions forming the nozzles to improve stage performance.

BACKGROUND OF THE INVENTION

The performance of a steam turbine is primarily determined by design of the steam path components, including the nozzles and bucket shapes. In that steam turbine path, the kinetic energy in the steam is converted to rotational energy in the turbine shaft, for example, for driving a generator. More particularly, the pressure and temperature of steam (and therefore the enthalpy) at any given intrastage location represents potential energy. The nozzle portion of a stage converts some of this potential energy into kinetic energy. The buckets following this nozzle portion convert this kinetic energy into rotational or shaft energy. This process repeats for each successive stage until the potential energy prescribed to remain at the exhaust of the stage group is reached. It is therefore important to minimize aerodynamic losses in the steam path to improve efficiency, while maintaining reliability and cost effectiveness.

Conventional practice in the design of a turbine stage is to provide for radial equilibrium along the flowpath between the partitions and end walls such that constant axial velocity and work is achieved at all radial positions or radial heights of the nozzle. Free vortex designs such as this have long been utilized, with the throat areas between partitions increasing linearly with radial outward distance from the hub of the stage. In certain applications, however, controlled vortex or reverse designs have been used in which the flow is biased radially inwardly in efforts to minimize secondary flow and profile losses in the hub region of the bucket receiving the nozzle flow. Impulse stage design results in bucket hub regions with large amounts of turning and historically this area has a larger fraction of the overall loss. Energizing this region with the reverse aerodynamic approach can have a beneficial result. However, this needs to be accomplished without causing hub and tip nozzle vortex interaction. If interaction does happen, this can substantially reduce the benefit of the reverse aerodynamic design. Generally speaking, a reverse design provides decreasing throat areas between partitions with increasing radial height. Significant secondary aerodynamic flow losses, however, can be caused by secondary flows (vortices) generated as the boundary layers along the inner and outer side walls of the turbine nozzle rows are turned through the nozzle. The stronger the vortices, the greater the losses. In the course of investigating the reverse design, it has been found that the vortices forming the secondary flows along the tips and bases of the partitions (adjacent the hub and tip end walls) can interact with one another to increase the aerodynamic losses. There appear to be cases when the throat passage geometry in particular effects the conditions for interaction. In addition, the reverse design may decrease the nozzle flow adjacent to the outer side wall too much, resulting in a poor flow distribution into the bucket, and excess swirl near the tip at the stage one exit plane. Hence, further refinements are necessary to the controlled vortex design to optimize radial flow distribution and minimize aerodynamic losses.

SUMMARY OF THE INVENTION

According to the present invention, the partitions forming the nozzles are uniquely configured to minimize the aerodynamic loss effects associated with the interaction of the secondary flows and poor flow distribution affording improved stage and turbine section performance. Particularly, in a preferred manifestation of the present invention, wherein partitions have throat openings which decrease or increase monotonically in the radial direction from the hub to the tip region of the steam path, portions of the trailing edges of the partitions forming the nozzles are cut back along their mean camber lines in directions toward the leading edges to increase stage and turbine section performance. The effect of the cut back of each trailing edge portion is to open the throat of the nozzle for the portion of the radial height where the cut back is applied. It will be appreciated that the cut back can be provided as original equipment (in the form of a "restacked" airfoil) or retrofitted to nozzles of existing steam turbines (as a "cut back").

In a preferred form of the present invention, the trailing edge portion of the partitions is modified, i.e., cut back from a location approximately mid-span or along the pitch line to the tip of the partitions in the reverse design where the throat areas decrease with increasing radius. That is, the trailing edges of this modified configuration are cut back from a mid-span or pitch line to the tips of the partitions to preferably linearly increase the throat area in comparison with the reverse flow design where the throat area linearly decreases with radial height. That is, the throat areas of the modified configuration hereof may still decrease with radial height but decrease to a lesser extent than otherwise using a full reverse design configuration. The cut back of the nozzle trailing edge portions is accomplished in the direction of the mean camber line of each partition and preferably varies linearly with the radius starting at the mid-span point, reaching a maximum at the tip radial location.

The present invention is also applicable to the free vortex design. In a free vortex design, the throat area between adjacent partitions opens with radial height. In the present modified configuration applied to a free vortex design, the throat area in the free vortex design is opened radially outwardly from the hub to a mid-span or pitch line location to a greater extent in comparison with the throat area of the free vortex design which normally increases linearly with radial height from hub to tip. By altering the throat areas by cutting back selected portions of the trailing edges of the partitions, interaction of the tip and hub vortices in the hot steam flowpath is minimized or eliminated, reducing additional secondary aerodynamic flow losses (secondary losses=vortex loss+vortex interaction loss), hence improving stage and section performance.

In a preferred embodiment according to the present invention, there is provided a nozzle for a turbine, comprising an array of partitions spaced circumferentially one from the other about an axis and between radially inner and outer end walls, each partition having a leading edge and a trailing edge, the trailing edge of each partition having first and second discrete edge portions extending linearly relative to one another and forming an included obtuse angle less than 180°, one of the first and second edge portions extending along a camber line of the partition in a direction toward the leading edge.

In a further preferred embodiment according to the present invention, there is provided a nozzle for a turbine, comprising an array of partitions spaced circumferentially one from the other about an axis and between radially inner and outer end walls, each partition having a leading edge and a trailing edge, the trailing edge of each partition having first and second edge portions and the first and second trailing edge portions of each partition defining first and second throat areas with a circumferentially adjacent partition, the throat area defined by one of the first and second edge portions and an adjacent partition opening to a greater extent than the throat area defined by another of the first and second edge portions thereof and the adjacent partition.

Accordingly, it is a primary object of the present invention to improve the aerodynamic performance of turbine stages by modification of the trailing edge portions of the partitions to modify the throat areas thereby controlling secondary flows.

BRIEF DESCRIPTION OF THE DRAWINGS

FIG. 1 is a perspective view of a pair of partitions constructed in accordance with the prior art;

FIG. 2 is a perspective view of a pair of partitions according to the present invention as viewed from their trailing edges;

DETAILED DESCRIPTION OF THE INVENTION

Referring to FIG. 1, there is illustrated a pair of partitions 10 forming part of a circumferential array of partitions about a turbine axis. The partitions have leading and trailing edges 12 and 14, respectively, and are disposed between end walls, that is, radially inner and outer end walls, for example, the walls 16 and 18 illustrated in FIG. 4. The complex shape of the partitions 10 is illustrated in FIG. 1 and the flowpath, for example, the steam flow in a steam turbine, is indicated by the arrow designated 20.

Figure 3:
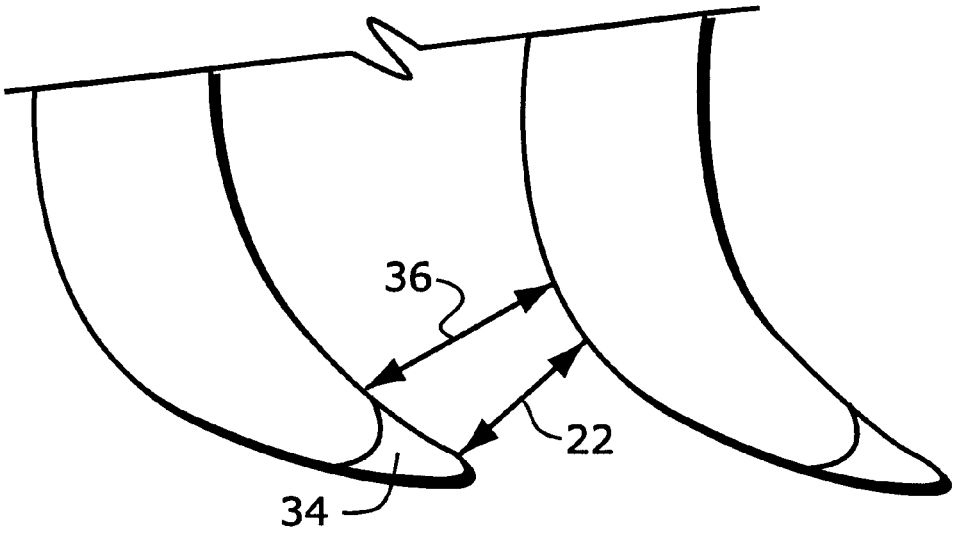
FIG. 3 is a radial view of the partitions of FIG. 2 illustrating the throat dimension in the reverse free vortex design of FIGS. 2 and 4.
Figure 3A:
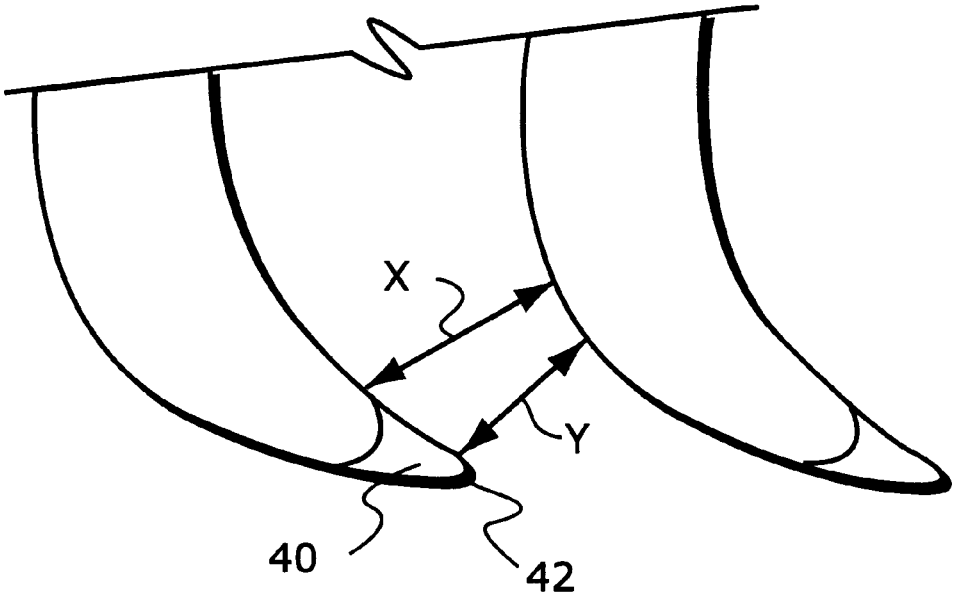
FIG. 3A is a radial view of the partitions of FIG. 5 as viewed looking radially outwardly illustrating the free vortex design with a cutback.
Figure 6:
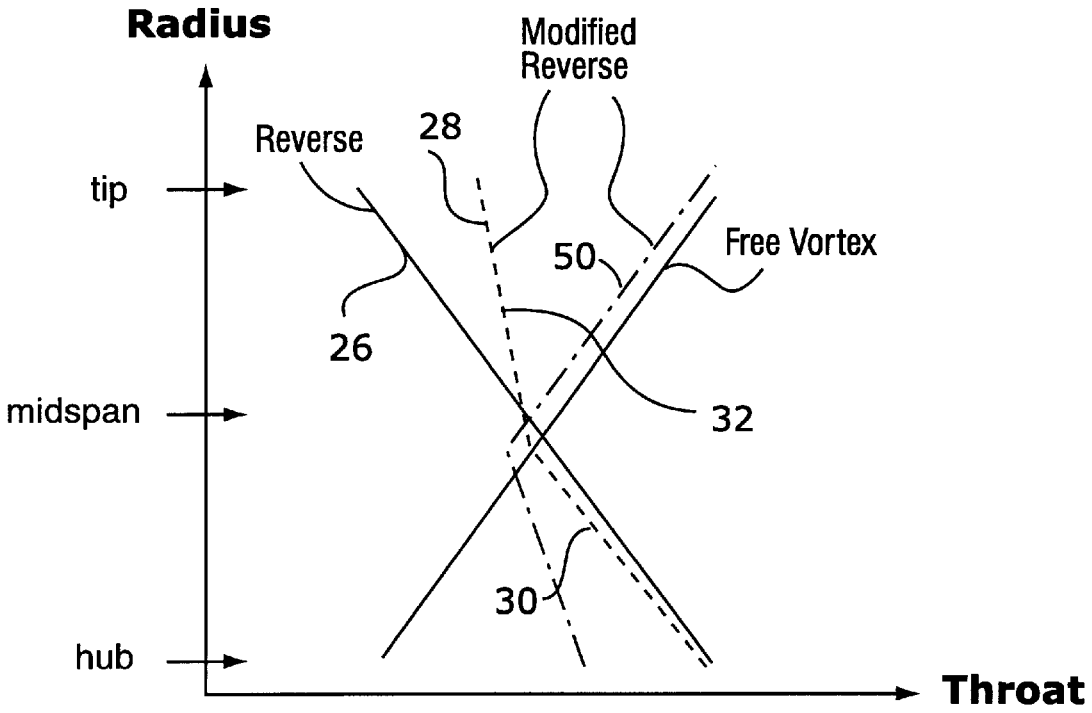
FIG. 6 is a graph representing throat area versus radial height of a partition for conventional free vortex and reverse designs with the modified reverse design according to an aspect of the present invention.

Referring to FIG. 3, it will be appreciated that the throat area, i.e., the shortest distance between suction and pressure sides of adjacent vanes, may be illustrated by the double-ended arrow 22. As illustrated in the graph of FIG. 6, the throat area 22 in a conventional free vortex partition design opens radially outwardly with radial height from the hub, i.e., the inner end wall, to the tip of the partition adjacent the outer end wall. As indicated previously, the free vortex design provides radial equilibrium along the flowpath between the partitions such that constant axial velocity and work is achieved at all radial positions at all radial heights of the nozzle. The reverse partition design illustrated by the line 26 in FIG. 6 has a decreasing throat area with increasing radial height. Also as indicated earlier, this latter design biases the flow radially inwardly. In a preferred form of the present invention, there is provided a modified reverse configuration indicated by the dotted line 28 in FIG. 6. In that modified reverse configuration, the throat area between adjacent partitions decreases, preferably monotonically, i.e., linearly, along a first section of the partition, as illustrated by the portion 30 of the dotted line 28 in FIG. 6. At substantially a mid-span radial height, the throat area decreases to a much lesser extent with radial height from mid-span to adjacent the tip or outer end wall, as illustrated by the portion 32 of dotted line 28. That is, the throat area decreases with increasing radial height from the mid-span to the tip relative to the decrease in throat area of partitions using a full reverse design. Thus, the throat area of the present design from mid-span outwardly may still decrease in area but to a lesser extent than if the full reverse design was used.

Figure 4:
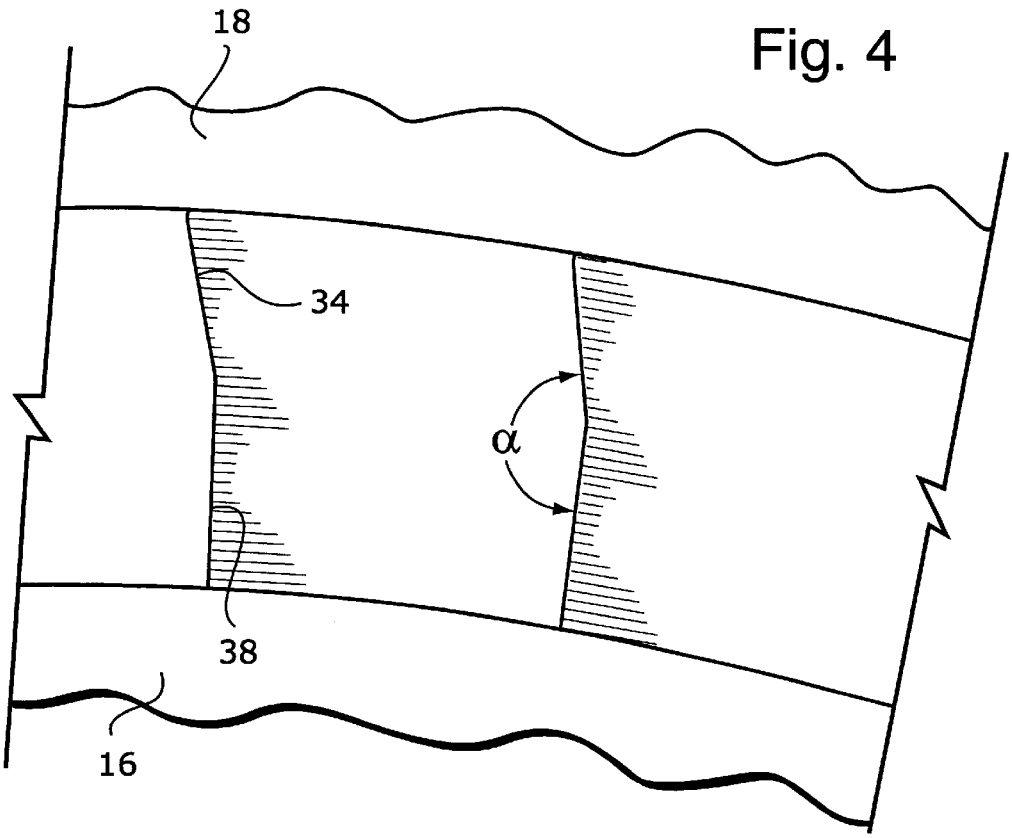
FIG. 4 is an axial view looking upstream of the partitions of a stage of a turbine as viewed along their trailing edges illustrating a form of the invention hereof.

As illustrated in FIGS. 2, 3 and 4, the increase in throat area from approximately mid-span to the partition tip in the modified reverse design relative to the decreasing throat area with radial height of the reverse design is accomplished by setting back the trailing edge of each partition from approximately the mid-span to the tip of the partition. This trailing edge setback is indicated at 34. As illustrated in FIG. 3, the setback 34 of the trailing edge increases the throat area as indicated by the double-ended arrow 36 in FIG. 3 from the mid-span to the tip of the partitions. Thus, it can be seen upon comparison of the throat areas designated by the arrows 22 and 36 that the increase in throat dimension provided by the trailing edge setback 34 causes the throat line, i.e., distance from the setback nozzle trailing edge to the nozzle convex or suction side to increase in length. To accomplish this, the partitions can be formed as original equipment with setbacks (designed into the airfoil shapes as a restack) or modified in the field as a retrofit by utilizing tools which will cut back the trailing edges of the partitions in the designated area. That is, the improved performance of the present invention can be obtained without changing the bucket aerodynamic configuration. Upon comparing the trailing edge from the hub to the mid-span and from the mid-span to the tip as illustrated in FIG. 3, it will be seen that both trailing edges are radiussed, with the trailing edge from the mid-span to the tip having the larger radius due to a cutback application. For a restack application, the trailing edge has a uniform radius along its entire length from the hub to the tip.

Preferably, the trailing edge portions, i.e., the non-setback portion 38 and the setback portion 34, extend linearly relative to one another and form an included obtuse angle $\alpha$ therebetween (FIG. 4) less than 180°. It is within the scope of this invention, however, to provide a non-linear trailing edge which extends non-linearly from the mid-span to the tip to increase the throat area relative to the throat area of the original reverse design. It will also be appreciated that the present invention can be manifested in a trailing edge setback which neither starts nor terminates exactly at mid-span but can start or terminate at approximately mid-span, for example, within a range of 10% of the radial height on either side of the mid-span. Also, the setback is provided along a camber line of each partition in a direction along that camber line toward the leading edge. Referring to FIG. 4, it will be seen that the non-setback portion 38 of the trailing edge of each partition lies generally along a radius of the partition assembly, i.e., relative to the stage axis. Additionally, the non-setback portion 38 lies in a plane substantially normal to the axis of the stage. It will be appreciated that sometimes the plane is not truly normal to the stage axis but rather is a very shallow conical surface due to the use of tapered nozzle partitions. Hence, the setback portion 34 of the trailing edge forms an angle with that plane and extends in a direction upstream relative to the flowpath 20.

Figure 5:
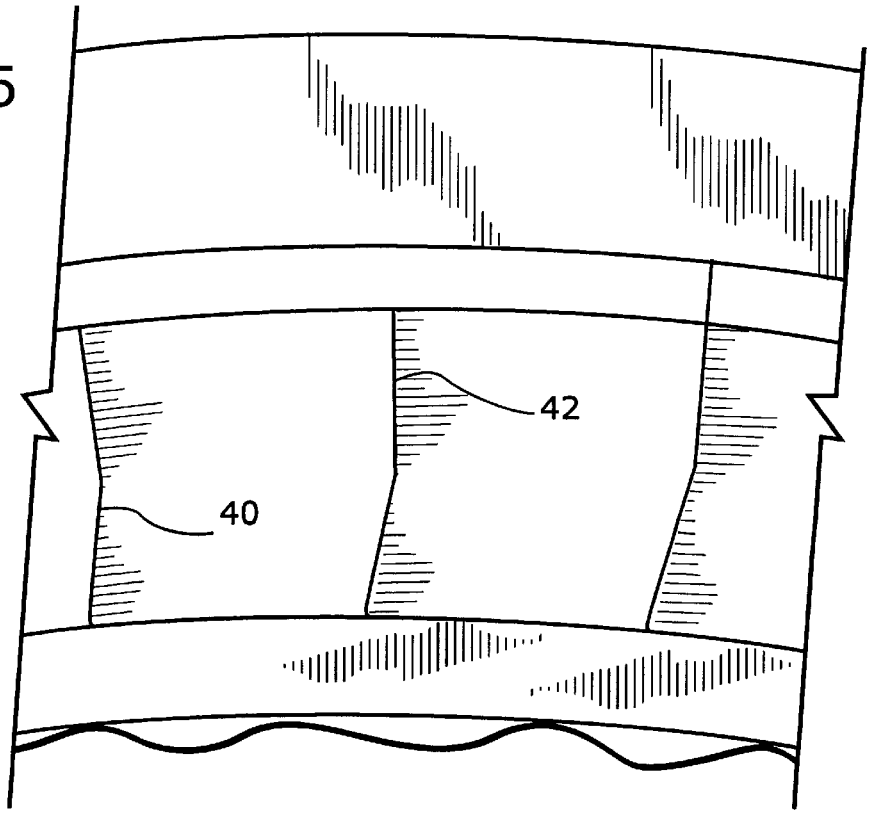
FIG.5 is a view similar to FIG. 4 illustrating a further form of the invention hereof.

Referring now to FIGS. 5 and 6, the present invention in another aspect also provides for increasing the throat area in a free vortex design from the hub to approximately mid-span to a greater extent than would be conventional in such free vortex design. To accomplish this, the trailing edge portion 40 from the hub to approximately the mid-span of the partition is set back to increase the throat area with radial height to a larger extent than would otherwise be the case with the free vortex design, as illustrated at 50 in FIG. 6. The remaining radial outer portion 42 of the trailing edge of the partition may lie substantially along a radius of the stage and in the plane normal to the axis of the stage. In both forms of the present invention, the secondary vortices which otherwise may interact with one another, resulting in additional secondary aerodynamic losses are believed maintained separate from one another by the setback of the trailing edge of each partition, thereby minimizing aerodynamic losses from the secondary flow effects.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle for a turbine, comprising:

an array of partitions spaced circumferentially one from the other about an axis and between radially inner and outer end walls, each partition having a leading edge and a trailing edge, adjacent partitions having throat dimensions defined by the shortest dimension between convex and concave sides thereof;

the trailing edge of each partition having first and second edge portions extending linearly;

the throat dimension defined by said first trailing edge portion of each partition and said convex side of an adjacent partition at corresponding radial locations relative to said axis decreasing from said inner end wall in a radially outward direction to an approximate mid-span radial height, the throat dimension defined by said second trailing edge portion of each partition and said convex side of said adjacent partition at corresponding radial locations relative to said axis increasing from adjacent said approximate mid-span radial height to said outer end wall.

2. A nozzle according to claim 1 wherein the throat dimensions at tip and root portions of adjacent partitions are substantially equal.

3. A nozzle according to claim 1 wherein the first trailing edge portion extends from the inner end wall radially outwardly and diverges away from the leading edge in a radially outward direction to a greater extent than the second trailing edge portion diverges away from the leading edge from the mid-span in a radially outward direction.

4. A nozzle according to claim 1 wherein said approximate mid-span radial height defines a minimum throat dimension.

5. A nozzle according to claim 1 wherein the throat dimensions at tip and root portions of adjacent partitions are substantially equal, wherein said approximate mid-span radial height defines a minimum throat dimension, said first and second trailing edge portions forming an included obtuse angle of less than 180°.

6. A method of increasing a throat dimension between adjacent partitions of an extant nozzle stage, each partition having a trailing edge, wherein the throat dimension opens with increasing radial height of each partition from an inner end wall to an outer end wall of said stage and is defined by the shortest dimension between convex and concave sides of adjacent partitions, comprising the step of cutting back a first portion of said trailing edge from said inner wall to an approximate mid-span radial height such that the throat dimension between each first trailing edge portion and said convex side of an adjacent partition at corresponding radial locations relative to an axis of the nozzle stage decreases in a radial direction from said inner end wall to said approximate mid-span radial height thereby providing an increase in throat dimension in comparison with the throat dimension of the extant nozzle stage.

7. A method of increasing a throat dimension between adjacent partitions of an extant nozzle stage, each partition having first and second trailing edge portions, wherein the throat dimension decreases with increasing radial height of each partition from an inner end wall to an outer end wall of said stage and is defined by the shortest dimension between convex and concave sides of adjacent partitions, comprising the step of cutting back the second trailing edge portion of said trailing edge from an approximate mid-span radial height of each partition to said outer end wall such that the throat dimension between each second trailing edge portion and said convex side of an adjacent partition at corresponding radial locations relative to an axis of the nozzle stage increases in a radial direction from said mid-span radial height to said outer end wall thereby providing an increase in throat dimension in comparison with the throat dimension of the extant nozzle stage.

* * * * *